252-96 AU 166 EX
6/19/79 XR 4,158,553

United States Patent [19]
Chapman

[11] 4,158,553
[45] Jun. 19, 1979

[54] NON-SCRATCHING LIQUID SCOURING CLEANSER USING ABRASIVES WITH A MOHS HARDNESS OF GREATER THAN 3

[75] Inventor: Francis E. Chapman, Racine, Wis.

[73] Assignee: S. C. Johnson & Son, Inc., Racine, Wis.

[21] Appl. No.: 869,416

[22] Filed: Jan. 16, 1978

[51] Int. Cl.[2] ..... C11D 9/02
[52] U.S. Cl. ..... 51/304; 106/8; 252/96; 252/98
[58] Field of Search ..... 51/303, 304, 306, 302; 252/95, 99, 98, 96; 106/3, 8

[56] References Cited

U.S. PATENT DOCUMENTS

| | | | |
|---|---|---|---|
| 2,817,195 | 12/1957 | Curtin | 51/304 |
| 2,907,649 | 10/1959 | Berkeley | 51/304 |
| 3,715,314 | 2/1973 | Morganstern | 252/95 |
| 3,754,878 | 8/1973 | Burke | 106/3 |
| 3,966,432 | 6/1976 | Rayner | 51/308 |
| 3,985,668 | 10/1976 | Hartman | 252/99 |
| 3,997,460 | 12/1976 | Sirine | 252/106 |
| 4,005,027 | 1/1977 | Hartman | 252/95 |

FOREIGN PATENT DOCUMENTS 249140 4/1961 Australia ..... 51/304

OTHER PUBLICATIONS

The Chemical Formulary, 1976, p. 329 and vol. 19.
Oils, Detergents and Maintenance Specialties, vol. 2, Formulary, 1967, pp. 173 and 174.

*Primary Examiner*—Donald J. Arnold

[57] ABSTRACT

A liquid scouring cleanser composition which does not scratch soft metals, yet has sufficient abrasive action to clean effectively using abrasives having a Mohs hardness of greater than 3, comprises from 2–15% by weight of a soap dispersion formed from the sodium, potassium, aluminum, zinc, calcium, magnesium, ammonium, mono lower alkyl amine, di lower alkyl amine, and tri lower alkyl amine fatty acid soaps, from 20–45% by weight of an abrasive having a Mohs hardness of greater than 3, from 1–7% by weight of an anionic and/or nonionic surfactant, from 0.2–10% by weight of a thickener, and water. The pH of the composition is from 7.0–9.5 and the ratio of abrasive to soap is within the range of from 10:1 to 3:1.

1 Claim, No Drawings

NON-SCRATCHING LIQUID SCOURING CLEANSER USING ABRASIVES WITH A MOHS HARDNESS OF GREATER THAN 3

BACKGROUND OF THE INVENTION

This invention relates to a liquid scouring cleanser type composition. More particularly, this invention relates to a liquid scouring composition which does not scratch soft materials, such as aluminum and stainless steel, and yet has sufficient abrasive action to clean effectively.

There are a number of patents describing scouring cleaner compositions. Many of these compositions use and disclose abrasives having all levels of hardness. However, compositions which have described themselves as being non-scratching utilize abrasives having a Mohs hardness of 3 or less, including abrasives such as calcium carbonate and the like. These compositions have some abrasive character, however, are sufficiently soft so that they do not scratch aluminum or stainless steel surfaces. Generally, on the Mohs hardness scale, abrasives with a hardness of less than 3 will not scratch aluminum and stainless steel while abrasives with a Mohs hardness of greater than 3 will scratch these materials.

It has also been known in the metal polish art to use abrasives having higher abrasive characteristics and Mohs hardness to clean metals and to combine these materials with fatty acids and base, such as ammonium and amines, as well as sodium hydroxide. However, these compositions are generally recommended for use on metals other than soft metals, such as silver and brass.

It has now been discovered that, by using appropriate ratios of abrasive to metal soap, hard abrasives having a Mohs hardness of greater than 3 can be used in aqueous liquid cleanser compositions usable on a variety of surfaces, including easily scratched surfaces such as aluminum and stainless steel. Further, it has been found that these compositions are highly efficacious in removing food encrustations and leave a hydrophobic film upon the surface cleaned so that the same may be easily dried and quickly reused.

OBJECTS AND ADVANTAGES

It is the primary object of the present invention to prepare a highly efficacious liquid scouring cleanser suitable for use on all surfaces.

It is a further object of the present invention to utilize as an abrasive in a liquid scouring cleanser suitable for use on all surfaces an abrasive having a Mohs hardness of greater than 3.

It is a still further object of the present invention to provide a composition which will not scratch soft surfaces yet has sufficient abrasive properties to remove baked-on encrustated deposits.

Further objects and advantages of the composition of the present invention will become more apparent from the following more detailed description thereof.

DETAILED DESCRIPTION OF THE INVENTION

The composition of the present invention comprises from 2–15% by weight of a fatty acid soap having the formula MOOCR wherein M is selected from the group consisting of sodium, potassium, aluminum, zinc, calcium, magnesium, ammonium, $(R_1)_mHnN+$ wherein m and n are 1, 2, or 3 and $m+n=4$, $R_1$ is an alkanol group having 1–4 carbon atoms, and mixtures thereof; from 20–45% by weight of an abrasive having a Mohs hardness of greater than 3; from 1–7% by weight of an anionic surfactant, nonionic surfactant and mixtures thereof; from 0.2–10% by weight of a thickener; and water; the composition having a pH of from 7.0–9.5 and a ratio of abrasive to soap of 10:1 to 3:1.

The agent used to cushion the effect of the hard abrasives utilized in the composition of the present invention are fatty acid soaps having 12–18 carbon atoms such as the stearate soaps, the tallate soaps, the oleate soaps, lamate soaps, palmatate soaps, and mixtures thereof. The preferred soaps are the fatty acid soaps having 16–18 carbon atoms such as the tallate soaps, oleate soaps, stearate soaps, and mixtures thereof. As the cation for these soaps, the following may be used: sodium, potassium, aluminum, zinc, calcium, magnesium, ammonium, $(R_1)_mHnN+$ wherein m and n are 1, 2 or 3 and $m+n=4$ and $R_1$ is a alkanol having 1–4 carbon atoms, and mixtures thereof. Representative soaps include sodium stearate, sodium oleate, triethanol amine tallate, potassium stearate, and the like. These fatty acid soaps, when used in the composition of the present invention at the appropriate ratio relative to the abrasives, provide a cushioning effect preventing the hard abrasives from scratching the soft material while at the same time not impeding the abrasive characteristic of the abrasive in so far as cleaning.

The preferred soaps for use in the composition of the present invention are the sodium, potassium and amine stearate soaps, the sodium, potassium and amine oleate soaps, the sodium, potassium and amine tallate soaps, and mixtures thereof. The most preferred are the potassium, sodium stearate soaps, the sodium and potassium oleate soaps, and mixtures thereof. These compositions have sufficient cushioning effect and also leave a shine on the surface which has just been cleaned.

Furthermore, the pH of the present composition is critical so as to provide the cushioning effect of these soap materials. At pH's above 9.5, the cushioning effect of these soaps is reduced so that the compositions begin to scratch surfaces which they will not scratch at a lower pH. Furthermore, at pH's of less than 7, the soap material is depressed to the foaming effect of the detergent present in the composition and, therefore, affects the overall detergency and cleaning effectiveness of the composition.

With regard to the amount of cushioning agent utilized in the composition of the present invention, from 2–15% by weight can be utilized, so long as the ratio of abrasive to soap is within the range of from 10:1 to 3:1. Furthermore, within the entire range, depending on the hardness of the abrasive utilized, more cushioning agent is necessary. For instance, using abrasives with a Mohs hardness of near 3, a ratio of 10:1 was acceptable. However, for very hard abrasives, such as silica, aluminum oxide and the like, it is preferred to use a ratio at the lower end of the range, i.e., in the neighborhood of 5:1 or 4:1. The preferred amount of cushioning agent is within the range of from 2–10% by weight, while the preferred ratio of abrasive to soap is from 4:1 to 10:1.

The second component of the composition of the present invention is the abrasive. Substantially any conventional abrasive can be used in the composition of the present invention. Abrasives with a Mohs hardness of less than 3 do not offer any advantage in the composition of the present invention as these abrasives are sufficiently soft so that they do not scratch soft surfaces. However, by using the soft abrasives in combination with the cushioning agent, these abrasives are less effective than they would otherwise be in other compositions. Conventional hard abrasives which are considered scratching abrasives, such as quartz, pumice, pumicite, titanium dioxide, aluminum oxide, silica sand, zirconium silicate, feldspar, silicon carbide and the like, can be used and can be present in a range of from 20–45% by weight and particularly from 25–35% by weight. Generally, these compositions have a particle size in the range of from 100–400 US Sieve Series Mesh, and preferably from 200–325 US Sieve Series Mesh.

The composition of the present invention also includes from 1–7% by weight of a surfactant. The surfactant provides the detergency to clean the surface. Preferred surfactants are anionic surfactants, nonionic surfactants and mixtures thereof as these compositions have high detergency and are compatible with the metal fatty acid soaps utilized as cushioning agents. Suitable anionic detergents include the alkyl sulfates, such as sodium lauryl sulfate, phosphate esters, alkanolamides, as well as ethoxylated versions of these materials, alkyl sulfonates, olefin sulfonates, alkyl aryl sulfonates, alkyl ether sulfates and the like. Nonionic compositions suitable for use in the composition include C10–18 alkanols reacted with from 5–100 moles of ethylene oxide, propylene oxide and mixtures, such as Neodol 4511, which is a reaction of 11 moles of ethylene oxide and one mole of C14–15 straight chain alkanol, the alkyl phenols reacted with 5–100 moles of ethylene propylene oxide, and mixtures.

The composition of the present invention also contains a small amount from 0.2–10% of a thickener to suspend the abrasive in the system, such as a montmorillonite, attapulgite, hectorite, or smectite clay, disclosures of these type materials are contained in U.S. Pat. No. 4,005,021, the disclosure of which is hereby incorporated by reference; natural gums such as xanthan, tragacanthin and the like; and synthetic thickeners such as CMC and the carboxypolymethylene such as the carbopols and the like.

The bulk of the composition of the present invention comprises water. Substantially any form of water can be utilized in the composition of the present invention. This water need not be deionized and need not be specially treated in any way.

The composition also may contain other optional ingredients in small amounts up to 5% such that they do not impede the total performance of the composition. These other ingredients include pigments, perfumes, preservatives and the like.

EXAMPLE 1

The following formulation was prepared by heating the water and the soap to 160° F. followed by blending in all other ingredients, but the sulfate which was added last:

| | |
|---|---|
| Feldspar | 16.6 |
| $Al_2O_3$ | 16.6 |
| 11.4% potassium stearate soap | 30.3 |
| Sodium lauryl sulfate (30%) | 16.3 |
| Bentonite clay | 4.7 |
| Water | 17.6 |

Abrasive to soap ratio - 10:1

This composition cleaned well, but did not scratch aluminum.

EXAMPLE 2

The following formulation was prepared as in Example 1:

| | |
|---|---|
| $Al_2O_3$ | 33.9 |
| 11.4% potassium stearate soap | 28.9 |
| Sodium dodecyl benzene sulfonate | 6.7 |
| Bentonite | 4.3 |
| Water | 26.2 |

Abrasive to soap ratio - 10:1

This composition performed well and had good scouring properties, but did not scratch aluminum.

EXAMPLE 3

The following composition was prepared using the procedure of Example 1:

| | |
|---|---|
| $Al_2O_3$ | 20.0 |
| $ZrSiO_4$ | 20.0 |
| Sodium dodecyl benzene sulfonate (60%) | 7.3 |
| Alkanol ethoxylate (Tergitol 15-5-7) | 1.8 |
| Bentonite | 0.4 |
| 19% potassium sterate potassium oleate (50:50) soap | 22.1 |
| Water | 28.4 |

Abrasive to soap ratio - 10:1

The composition had good scouring properties, but did not scratch aluminum.

EXAMPLE 4

The following composition was prepared using the procedure of Example 1:

| | |
|---|---|
| 20% potassium tallate | 37.6 |
| $Al_2O_3$ | 25.9 |
| Mica | 13.9 |
| Sodium alkyl aryl sulfate | 1.5 |
| Sodium ethoxylate | 2.8 |
| Bentonite | 0.3 |
| Water | 18.0 |

Abrasive to soap ratio - 3.4:1 (Mica not included in abrasive.)

This example shows that at a ratio of 3.4:1 good cleaning is possible, while there is no scratching of the aluminum. Also, mica is not considered as an abrasive as its Mohs hardness is 2.8. Small amounts of softer abrasive obviously can be added.

What is claimed is:

1. An aqueous liquid scouring cleanser consisting essentially of:

2–10% by weight of a fatty acid soap having the formula MOOCR wherein M is selected from the group consisting of sodium, potassium and $(R_1)mHnN+$, wherein m and n are selected from 1, 2 or 3 and $m+n=4$, $R_1$ is an alkanol group having 1–4 carbon atoms and mixtures thereof, and R is a saturated or unsaturated alkyl group selected from the group of stearyl, aleayl and mixture thereof;

25–35% by weight of an abrasive having a Mohs hardness of greater than 3;

1–7% by weight of an anionic surfactant, nionic surfactant or mixtures thereof;

0.2–10% by weight of a thickener; and water;

the composition having a pH within the range of 7.0–9.5 and a ratio of abrasive to soap of from 10:1 to 4:1.

* * * * *